US006047536A

United States Patent [19]

Naylor et al.

[11] Patent Number: 6,047,536

[45] Date of Patent: Apr. 11, 2000

[54] TEXTILE MACHINE ARRANGEMENT

[75] Inventors: Geoffrey Naylor, Macclesfield; Bipin Chauhan, Bolton; John Gordon Harland, Wilmslow, all of United Kingdom

[73] Assignee: Rieter Scragg Limited, United Kingdom

[21] Appl. No.: 09/141,049

[22] Filed: Aug. 27, 1998

[30] Foreign Application Priority Data

Sep. 5, 1997 [GB] United Kingdom ..... 9718983

[51] Int. Cl.[7] ..... D01H 7/46

[52] U.S. Cl. ..... 57/290; 57/284; 57/352

[58] Field of Search ..... 28/249; 57/290, 57/352, 284, 264, 265

[56] References Cited

U.S. PATENT DOCUMENTS

| | | | |
|---|---|---|---|
| 3,583,145 | 6/1971 | Fisher | 57/290 |
| 4,236,323 | 12/1980 | Dammann et al. | 57/284 |
| 4,398,386 | 8/1983 | Endo et al. | 57/290 |
| 4,905,468 | 3/1990 | Tanae et al. | 57/290 |
| 5,148,666 | 9/1992 | Bauer et al. | 57/290 |
| 5,404,705 | 4/1995 | Yanagihara et al. | 57/290 |
| 5,649,345 | 7/1997 | Menegatto | 57/284 |
| 5,671,519 | 9/1997 | Naylor | 57/290 |
| 5,718,109 | 2/1998 | Fujita | 57/290 |
| 5,918,455 | 7/1999 | Gabalda et al. | 57/290 |

FOREIGN PATENT DOCUMENTS

| | | | |
|---|---|---|---|
| 3301510 | 8/1983 | Germany | 57/290 |
| 1139838 | 6/1989 | Japan | 57/284 |

*Primary Examiner*—William Stryjewski
*Attorney, Agent, or Firm*—Renner, Otto, Boisselle & Sklar, LLP

[57] ABSTRACT

A textile machine for texturing textile yarns by false twisting, heating and cooling the false twisted yarns, has yarn feeding devices, a heating device with a heated surface, a cooling zone and a false twisting device. The feeding devices are operable to feed a yarn along a longitudinal yarn path in contact with the heated surface, through the cooling zone and the false twisting device. In such a machine, to provide that the surge speed is higher than would be the case with a conventional contact heater arrangement or guided non-contact heaters, to allow processing at these higher speeds without detriment to the yarn properties, and to minimize the temperature settings and hence the power consumption of the heater, the heated surface is substantially flat along the longitudinal yarn path, and the yarn path in the cooling zone extends in a direction different from that of the longitudinal yarn path. Preferably the heating device is substantially horizontal and the cooling zone is inclined downwardly from the heating device to the false twisting device.

18 Claims, 2 Drawing Sheets

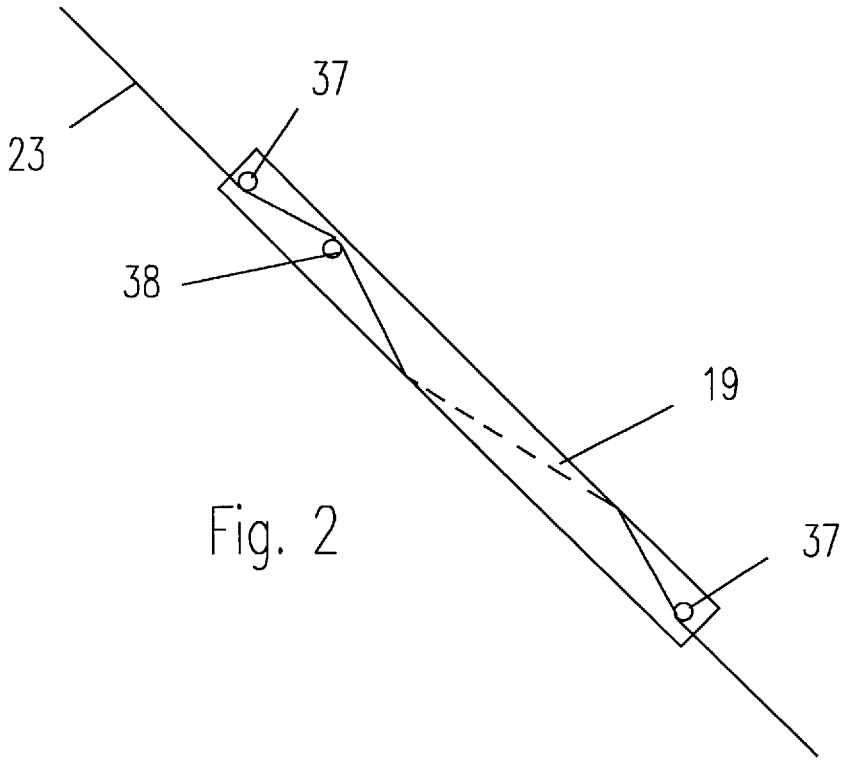
Fig. 2
Fig. 3
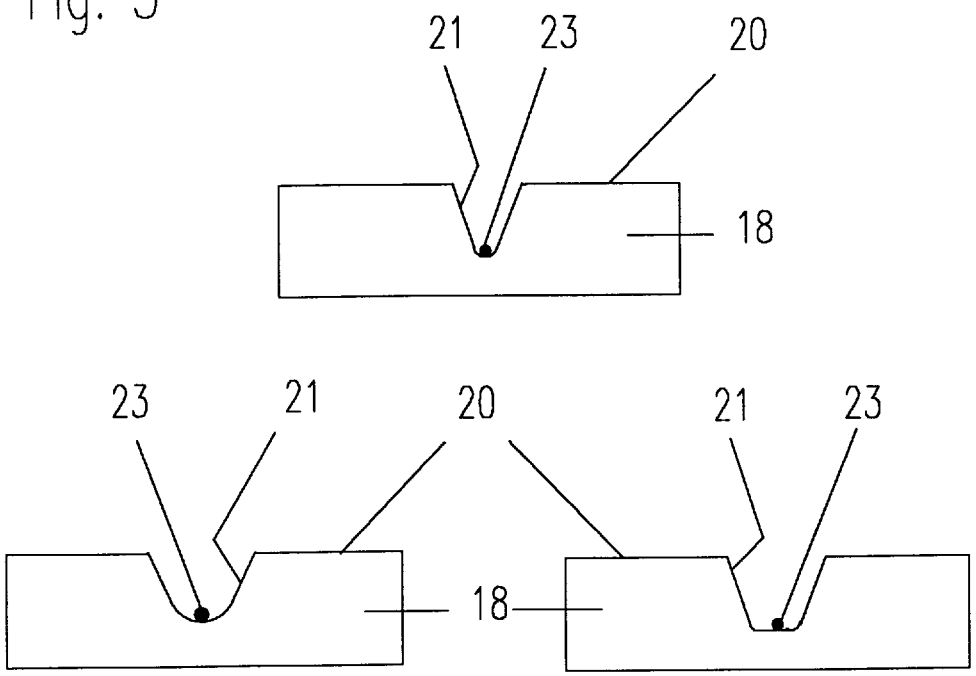

TEXTILE MACHINE ARRANGEMENT

FIELD OF THE INVENTION

This invention relates to heating arrangements in textile machines, and in particular to heating arrangements in machines for texturing textile yarns by false twisting, heating and cooling the false twisted yarns, and winding up such yarns.

BACKGROUND OF THE INVENTION

Textile machines of this type are well known. Conventionally, in many false twist texturing machines, the heating of the yarns is performed by passing the yarns in contact with the surface of a heated plate. Parallel grooves are formed in the surface of the plate so as to guide the yarns and prevent interference of one yarn with an adjacent yarn. Such a plate is formed having a curvature of relatively large radius in the longitudinal direction of the passage of the yarns over the surface, so that the tension in the yarns keeps the yarns in contact with that surface and maintains control of the long lengths of yarn. This arrangement facilitates the transfer of heat from the heated surface to the yarns, thereby keeping to a minimum the length of the heater required to raise the temperature of the yarns to that desired for correct processing. For heaters of between 0.2 m and 3 m in length, typical curvatures lie in the range of 5 m to 20 m radius.

It is an obvious aim of textured yarn producers to maximise the production of textured yarn from any texturing machine, by increasing the machine speed and hence the throughput speed of the yarn. It is also desirable to minimise the length of the heater by maximising the rate of heat transfer from the heater to the yarn. One of the limitations to increasing the speed of the machine is the 'surge speed', a yarn throughput speed at which dynamic threadline instability occurs. This speed is affected by yarn tension, the rate of twist insertion and machine configuration. At this speed, the high rotational speed of the twisting yarn tends to create uncontrolled vibrations in the running yarn, and this causes rapid variations in tension and in the twist level inserted in the yarn by the twisting unit, thereby producing unacceptable yarn. It has always been regarded as essential that the vibrations in the yarn be minimised throughout the heating and cooling zones so as to raise the surge speed as much as possible. To this end, and to maximise the heat transfer to the yarn, the yarn is controlled by being maintained in contact with the heater surface by virtue of the yarn tension and the longitudinal curvature of the heater. Alternatively, for high temperature and non-contact heaters, guides have been located on the heater to provide a curved or sinuous path for the yarn on or adjacent the heated surface.

OBJECTS OF THE INVENTION

The objects of the present invention are to provide a heating arrangement in a textile machine in which the surge speed is higher than would be the case with a conventional contact heater arrangement or guided non-contact heaters, to allow processing at these higher speeds without detriment to the yarn properties, and to minimise the temperature settings and hence the power consumption of the heater.

SUMMARY OF THE INVENTION

The invention provides a textile machine for texturing textile yarns by false twisting, heating and cooling the false twisted yarns, comprising in sequence yarn feeding devices, a heating device with a heated surface, a cooling zone and a false twisting device, wherein the feeding devices are operable to feed a yarn along a longitudinal yarn path in contact with the heated surface, through the cooling zone and the false twisting device, wherein the heated surface is substantially flat along the longitudinal yarn path, and wherein the yarn path through the cooling zone extends in a direction different from that of the longitudinal yarn path.

The heating device may have a groove in the heated surface for receiving a running yarn therein. The yarn may be unsupported over a length of between 25 and 35 cm immediately prior to its contact with the heating device, and preferably over a length of substantially 28 cm.

The cooling zone may be inclined to the plane of the heating surface. The heating device may be substantially horizontal and the cooling zone may extend downwardly from the heating device to the false twisting device. The cooling zone may be inclined at between 10° and 60° to the horizontal. Preferably the yarn path between the heating device and the false twisting device is curved. The cooling zone may comprise a cooling device in the form of a tube having yarn guides disposed adjacent the inlet and outlet ends thereof and positioned to guide a running yarn in a substantially helical path along the outer surface of the tube. In operation, a running yarn may make a plurality of turns around the surface of the cooling tube between the inlet and outlet guides. A cooling fluid may be passed through the cooling tube.

BRIEF DESCRIPTION OF THE DRAWINGS

The invention will now be described with reference to the accompanying drawings in which:

FIG. 2 shows an alternative yarn path on the cooling tube of the machine of FIG. 1, and FIG. 3 shows alternative versions of the heater of the machine of FIG. 1.

DESCRIPTION OF THE PREFERRED EMBODIMENTS

Figure 1:
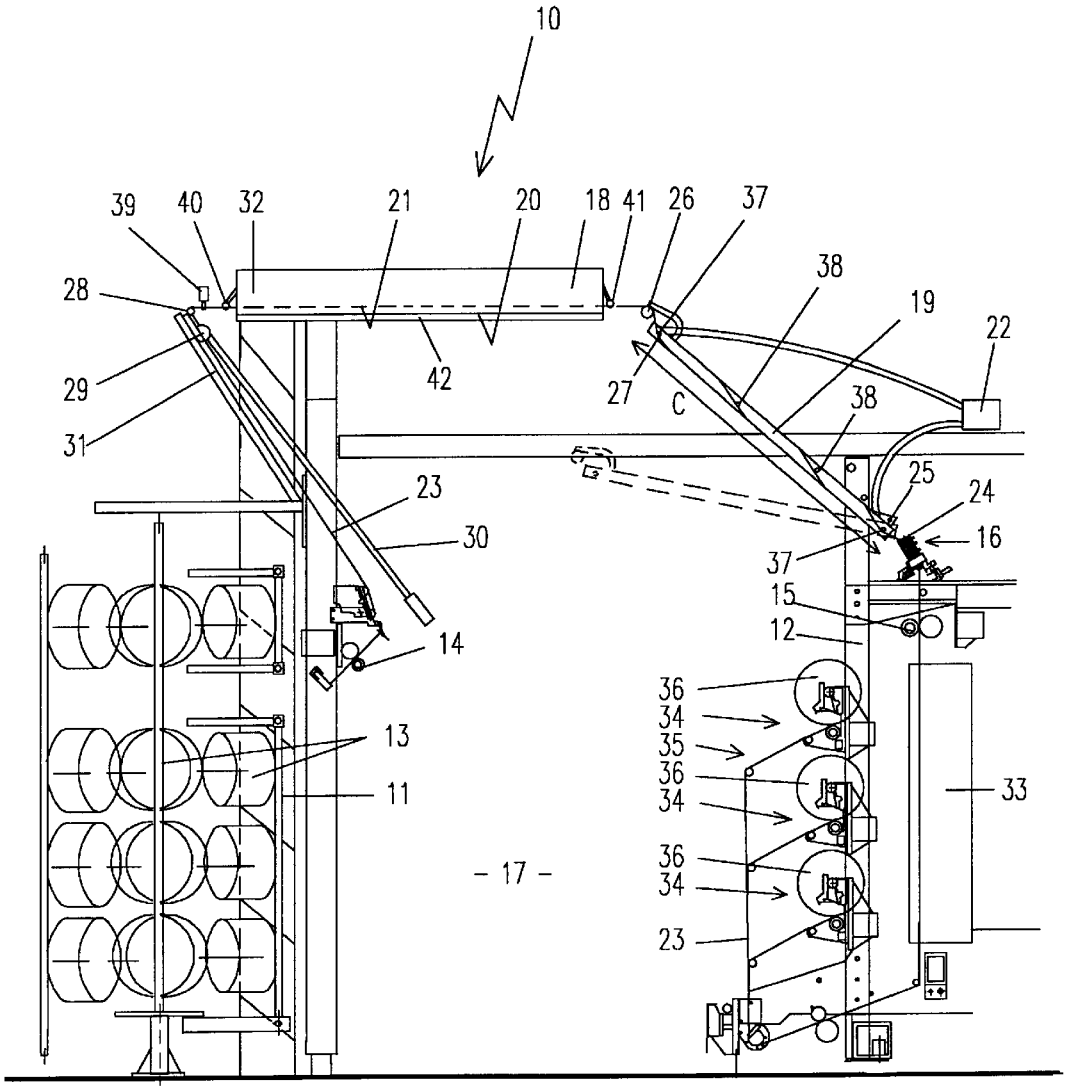
FIG. 1 is a threadline diagram of one embodiment of machine.

Referring to FIG. 1, there is shown a textile machine 10, comprising a first frame or creel 11 and a second frame 12. Mounted in the first frame or creel 11 are several packages 13 of supply yarn. Also mounted on the first frame 11 is a first feed device 14 in the form of a feed and nip roller pair. Mounted on the second frame 12 is a second feed device 15, also in the form of a feed and nip roller pair, and a false-twist device 16. The frames 11, 12 are spaced from each other to provide an operator's aisle 17 between them. Above the operator's aisle 17 is a substantially horizontally disposed first heating device 18 and, in a cooling zone C, a cooling device 19 mounted on the second frame 12 in the operating position shown in full lines. The heating device 18, which may have a length of between 0.2 and 2.5 m, has a downwardly facing, longitudinally substantially flat, heated surface 20 in which there is a groove 21. To reduce the length of heating device required for adequate heating of the yarn 23, the heating device 18 may operate at a temperature above the melting point of the yarn 23, i.e. above 150° C., and up to 800° C. The cooling device 19 is in the form of a tube, and has guides 37 disposed adjacent the inlet and outlet ends thereof to guide the running yarn 23 in a helical path, making two or three turns as it travels the length of the cooling tube 19. There may be additional guides 38 located on the tube 19 along the helical yarn path to aid the stability of the yarn 23 in this region. Alternatively, as shown in FIG. 2, such additional guides 38 may be used to reverse the direction of the helical path of the yarn 23 so that for ease of threading it makes no or only one turn around the tube 19 whilst maintaining the path length and process control. A cooling fluid may be passed through the tube 19. This may be effected by withdrawing air from the tube 19 through an aperture adjacent the otherwise sealed inlet end, cooler air entering the tube at the open outlet end. Alternatively the cooling fluid may be supplied from a cooling fluid supply device 22 to circulate through the cooling tube 19. In either case the flow of fluid serves to enhance the cooling effect and thereby reduce the length of the cooling device 19 required for adequate cooling of the yarn 23. The cooling device 19 is inclined downwardly towards the false-twist device 16 at an angle of between 10° and 60° to the horizontal, thereby aligning the incoming yarn 23 to pass over the surface of the first working friction disc 24 of the false-twist device 16 at the desired angle. A yarn guide 26 which is mounted adjacent the inlet end 27 of the cooling tube 19, may, for threading purposes, 'drop-down' a track (not shown) adjacent the cooling tube 19 in the manner of the sledge 29 on the track 31 as explained below. Alternatively, the cooling tube 19 may be mounted so as to be pivotal about its outlet end 25 downwardly to the threading position shown in dotted lines. With either arrangement, the yarn 23 is able to be threaded over the yarn guide 26 in its lowered position and the guide 26 can then be raised or the tube 19 can be pivoted upwardly to restore the machine 10 to its operating configuration. At this stage of threading the yarn 23 will extend in a straight line between the first yarn feed device 14 and the yarn guide 26. The yarn 23 is then passed over a twist stopping yarn guide 28 on a sledge 29 which is pushed either pneumatically or by means of a rod 30 so as to slide upwardly along a sledge track 31 extending between the first yarn feed device 14 and the inlet end 32 of the first heating device 18. The heater door 42 is open at this stage, and this movement of the sledge 29 places the yarn 23 in contact with guides 40, 41 accurately located on outside of the casing of heater 18 so as in turn to accurately align the yarn 23 in the groove 21 in contact with the downwardly facing heated surface 20. Even when the heater door 42 is closed, the yarn 23 is visible as it passes over the yarn guides 40, 41 so that, in operation, the accurate alignment of the yarn 23 within the heater 18 can be verified. After passing through the false-twist device 16, the yarn 23 passes through the second feed device 15, via an optional second heating device 33 to a package winding mechanism 34 located in a take-up section 35. The second heating device 33, if fitted, and the take-up section 35 are disposed in the second frame 12, the take-up section facing the first frame 11 across the operator's aisle 17. In this case the packages 36 of textured yarn are removed from the machine 10 by the operator or by an automatic doffing mechanism (not shown) operating in the operator's aisle 17.

The invention is equally applicable to alternative configurations of machine, for example three frame machines or machines in which the first heater 18 is at substantially the same height as the first feed device 14 and the sledge 29 and track 31 are dispensed with.

Referring now to FIG. 3, there is shown alternative forms of the groove 21 in the heated surface 20 of the first heater 18. In the first case shown uppermost in the Figure, the groove 21 is relatively narrow, the bottom of the groove 21 being of comparable radius to that of the yarn 23, e.g. a 0.5 mm radius. Such a groove 21 is typical of the grooves provided in the conventional heaters of longitudinally curved form currently in use. However, in the second case shown on the lower left of the Figure, the groove 21 is relatively wide, the bottom of the groove 21 being of larger radius than that of the yarn 23, e.g. up to 4 mm radius. In the third case shown on the lower right of the Figure, the groove 21 is 'flat bottomed'. In the second and third cases the yarn 23 is more able to vibrate laterally than in the first case, and such vibrations may be controlled by the choice of the shape of the groove 21 in relation to the yarn 23 being processed. The vibrations will occur naturally, but also may be induced by means of a vibrator device or air jet 39 (FIG. 1), thereby providing further control. This vibration continuously brings the running yarn 23 into contact with parts of the heated surface of the groove 21 which have not been cooled by the travel of the immediately preceding length of yarn 23, thereby enhancing the transfer of heat from the heated surface 20 to the yarn 23. This enhanced vibration may also assist in cleaning the surface of the groove 21, in reducing the possibility of the yarn 23 sticking that surface if a yarn break occurs, and in entraining from the heater 18 fumes which would otherwise accumulate adjacent the downwardly facing surface 20. Furthermore a more uniform texturing of the yarn 23 is believed to be a consequence of the enhanced vibration of the yarn 23 on the heater 18 tending to mask the transient variations of tension in the yarn 23 as it issues from the supply package 13 in the creel 11. The distance between the twist stopping yarn guide 28 and the guide 40 on the heater door is between 25 and 35 cm, preferably substantially 28 cm. Too large a distance would provide too great a length of unsupported yarn 23 leading to process instability, whereas too small a distance would tend to inhibit the vibrations in the yarn 23.

It has been found in the case of the longitudinally substantially flat heater 18 coupled with the control of the yarn 23 in the cooling zone C of the present invention that, contrary to what has previously been believed, the lack of the longitudinal curvature or lateral sinuous yarn path which is provided in conventional heaters does not reduce the surge speed or the transfer of heat to the yarn 23. Surprisingly, it has been found that an increase in the surge speed of up to 200 m/min can be obtained using the present arrangement compared with the use of a conventional longitudinally curved heater of similar dimensions and heating capabilities with or without the generally desirable straight yarn path through the heater and cooling zone. This may be due to being able to run at higher yarn tensions since the near-molten yarn is not dragged over a hot longitudinally curved surface or in a sinuous path around hot yarn guides. Improved yarn properties are believed to be a consequence of this. Furthermore it has been found that increasing the yarn throughput speed through the heater 18, whilst maintaining the heater temperature constant, can produce an increase in the temperature of the yarn 23 on exit from the heater 18. This effect is opposite to that experienced with conventional contact heaters. The favourable effects on surge speed and heat transfer in the present case are believed to result from the increased lateral vibration in the yarn 23 on the present heater 18, whilst such vibration is restricted in the cooling zone due to the inclination of the cooling tube 19 to the plane of the heater surface 20 and the curvature of the yarn path around the tube 19.

It is believed that the increase in lateral vibration breaks the static friction and provides a mechanism for the dissipation of twisting energy, at a distance remote from the region of twist creation by the twist unit 16, which is isolated from these phenomena by the close control afforded by the helical path around the cooling tube 19.

What is claimed is:

1. A textile machine for texturing textile yarns by false twisting, heating and cooling the false twisted yarns, comprising in sequence yarn feeding devices, a heating device with a heated surface, a cooling zone and a false twisting device, in which the feeding devices are operable to feed a yarn along a longitudinal yarn path in contact with the heated surface, through the cooling zone and the false twisting device, wherein the heated surface is substantially flat along the longitudinal yarn path, and wherein the yarn path through the cooling zone extends in a direction different from that of the longitudinal yarn path.

2. A textile machine according to claim 1, wherein the heating device has a length of between 0.5 and 2.5 m.

3. A textile machine according to claim 1, wherein the heating device has a groove in the heated surface for receiving a running yarn therein.

4. A textile machine according to claim 3, wherein the groove has a bottom with a radius of between 0.5 mm and 4 mm.

5. A textile machine according to claim 3, wherein the groove has a bottom which is flat.

6. A textile machine according to claim 3, wherein the groove is in a downwardly facing heated surface of the heating device.

7. A textile machine according to claim 1, comprising yarn guides located on the outside of the heating device.

8. A textile machine according to claim 1, wherein the heating device when operating has a temperature of between 150° C. and 800° C.

9. A textile machine according to claim 1, wherein the yarn is unsupported over a length of between 25 and 35 cm immediately prior to its contact with the heating device.

10. A textile machine according to claim 9, wherein the yarn is unsupported over a length of substantially 28 cm.

11. A textile machine according to claim 1, wherein the heating surface lies in a plane and the cooling zone is inclined to the plane of the heating surface.

12. A textile machine according to claim 11, wherein the heating device is substantially horizontal and the cooling zone is inclined downwardly from the heating device to the false twisting device.

13. A textile machine according to claim 12, wherein the cooling zone is inclined at an angle of between 10° and 60° to the horizontal.

14. A textile machine according to claim 1, wherein the yarn path in the cooling zone is curved.

15. A textile machine according to claim 1, wherein the cooling zone comprises a cooling device in the form of a tube.

16. A textile machine according to claim 15, wherein the tube has an outer surface and inlet and outlet ends, and has yarn guides disposed adjacent the inlet and outlet ends and positioned to guide a running yarn in a substantially helical path along the outer surface.

17. A textile machine according to claim 16, wherein the tube has additional yarn guides located along a helical path between the inlet and outlet guides.

18. A textile machine according to claim 15, wherein a cooling fluid is passed through the tube.

* * * * *